United States Patent [19]

Bothner

[11] 4,430,774

[45] Feb. 14, 1984

[54] COMBING AND DRAWING FRAME

[75] Inventor: Jakob Bothner, Göppingen-Jebenhausen, Fed. Rep. of Germany

[73] Assignee: Zinser Textilmaschinen GmbH, Ebersbach, Fed. Rep. of Germany

[21] Appl. No.: 332,855

[22] Filed: Dec. 21, 1981

[30] Foreign Application Priority Data

Dec. 22, 1980 [DE] Fed. Rep. of Germany ..... 3048501

[51] Int. Cl.[3] ..... D01H 5/18

[52] U.S. Cl. ..... 19/105; 19/258

[58] Field of Search ..... 19/105, 288, 293, 233, 19/258

[56] References Cited

U.S. PATENT DOCUMENTS

| | | | |
|---|---|---|---|
| 468,202 | 2/1892 | Lamson | 19/105 X |
| 2,128,130 | 8/1938 | Farrar | 19/105 |
| 2,187,830 | 1/1940 | Jones | 19/292 X |
| 2,442,333 | 6/1948 | Bacon | 19/105 |
| 3,537,145 | 11/1970 | Meert et al. | 19/288 X |
| 3,762,146 | 10/1973 | Landwehrkamp | 19/105 X |
| 4,083,085 | 4/1978 | Livingston et al. | 19/105 |

FOREIGN PATENT DOCUMENTS

| | | | |
|---|---|---|---|
| 2803467 | 8/1979 | Fed. Rep. of Germany . | |
| 49-26971 | 7/1974 | Japan | 19/105 |
| 930065 | 7/1963 | United Kingdom . | |
| 2057522 | 4/1981 | United Kingdom | 19/105 |

*Primary Examiner*—Louis Rimrodt

*Attorney, Agent, or Firm*—Karl F. Ross; Herbert Dubno

[57] ABSTRACT

The combing and drawing frame having a comber cylinder provided with sawtooth clothing, which is surrounded over part of its circumference by a fixed comber bed with sawtooth clothing and which is mounted in front of at least one pair of drawing rolls and mounted behind at least one pair of drawing rolls, comprises a feed device or guide for the sliver which is to be processed, this feed device being capable of being adapted to fit closely against the comber cylinder so as to improve the quality of the sliver which is processed. The feed device may be in the form of a lap plate or a feed roll, each being associated with an upper feed roll.

13 Claims, 4 Drawing Figures

COMBING AND DRAWING FRAME

FIELD OF THE INVENTION

The invention relates to a combing and drawing frame for a spinning mill. More particularly, the invention relates to a combing and drawing frame of the type in which a pair of feed rolls supplies the sliver to a comber cylinder or drum.

BACKGROUND OF THE INVENTION

The collection of fibers (also known as sliver) to be drawn and combed in a combing and drawing frame of this kind is relatively wide. For example, the working width of a combing and drawing frame may be 160 mm and the width of the collection of fibers to be processed therein may be as wide as the working width of the combing and drawing frame. The fibers in the collection of fibers, or sliver, may be cotton or other fibers such as rayon staple fibers, man-made fibers or the like which are similar in length to cotton fibers.

In a known combing and drawing frame (see German patent document No. 28 03 467 and U.S. Pat. No. 4,083,085) the two rolls of the pair of feed rolls are mounted at a small spacing from the comber cylinder and supply the sliver directly to the comber cylinder and comber bed.

However, owing to the high loading pressure required for clamping the sliver in the nip of the pair of feed rolls, the lower feed roll must have a large external diameter so that it is capable of absorbing the high loading pressure. As a result, the nip of the pair of feed rollers is at a relatively large spacing from the point where the comber cylinder starts to comb the sliver, and this leads to substantial irregularities in the sliver.

OBJECTS OF THE INVENTION

The principal object of the invention is to improve the regularity or uniformity of the sliver treated in the combing and drawing frame.

Another object of the present invention is to provide an improved combing and drawing frame of the type described which is capable of compensating for very large spacings of the feed rolls from the comber cylinder or drum.

SUMMARY OF THE INVENTION

These objects and others which will become apparent hereinfter are attainable in a combine and drawing frame for a spinning mill (e.g. a cotton spinning mill), for drawing and combing drawable collections of fibers (sliver) consisting of individual cotton fibers or the like which comprises a pair of feed rolls that deliver the collection of fibers to a comber cylinder cooperating with a comber bed, the surface speed of the comber cylinder being greater than the surface speed of the feed rolls, and a pair of delivery rolls mounted behind the comber cylinder.

According to the invention, between the pair of feed rolls and the comber cylinder and mounted in front of the comber bed, there is a deflection guide for the sliver, this guide being at a small spacing from the comber cylinder and pressing the sliver against the upper feed roll.

As the sliver is guided by the deflection guide behind the nip of the pair of feed rollers, the drawing of the sliver effected by the comber cylinder is controlled better and the uniformity of the sliver is improved substantially. Moreover, the comber cylinder starts its combing operation at a smaller spacing from the nip of the pair of feed rolls. Thus, the measure according to the invention also improves the combing operation and the paralleling of the fiber.

According to a preferred embodiment of the invention, the deflection guide is also at a small spacing from the upper feed roll. This spacing is such that the sliver is pressed with slight pressure against the upper feed roll.

In order that the spacing of the deflection guide from the comber cylinder or the spacing of the deflection guide from the upper feed roller can be adapted as far as possible to different slivers, preferably at least one of these spacings is adjustable, and better still both spacings are aadjustable.

In a preferred embodiment of the invention, the deflection guide is constructed as a stationary deflection guide slideway for the sliver, and comprises a first portion opposite the upper feed roll and a second portion opposite the comber cylinder.

A stationary deflection guide slideway of this kind is particularly simple in construction and not only ensures highly effective guiding of the fibers but also makes it possible to deflect the sliver in a narrow arc towards the comber cylinder.

Preferably, the first and second portions are connected to each other via a rounded intermediate portion. However, in many cases, it is also possible for these two portions to be connected by an intermediate portion of some other form, for example by a substantially planar intermediate portion or by an intermediate portion which is concave in the longitudinal direction, or the two portions can be arranged at a spacing from each other without being interconnected in any way.

Advantageously, the intermediate portion can have an arc-shaped curvature, and it has proved particularly advantageous for the radius of curvature to be about 3 to 5 mm, more particularly about 4 mm.

In order to fit the circumferential curvature of the upper feed roll or comber cylinder located opposite them, the first and second portions can be curved in a concave shape or can each have a concave curvature. This has a particularly favorable effect on the regularity of the slivers treated in this combing and drawing frame. However, in many cases, it is also possible to construct the first and/or second portions differently, e.g. as planar.

The deflection guide slideway is appropriately totally smooth, preferably in the form of a polished metal surface, so that the sliver will slide easily over it. The deflection guide slideway extends at least over the working width of the combing and drawing frame and preferably has a constant profile in the direction parallel to the rotation axis of the comber cylinder.

Furthermore the deflection guide slideway may be formed by a surface portion of a rail, preferably a profiled rail, extending parallel to the longitudinal axis of the comber cylinder and the upper feed roll. In some cases, however, it is also possible for the first and second portions to be provided on different rails or the like.

In another embodiment of the invention, the deflection guide is constructed as a rotatably mounted guide roll which has a substantially smaller diameter than the rolls of the pair of feed rolls. This guide roll also ensures effective guiding of the sliver and deflects it in a narrow arc to the comber cylinder, the radius of this arc corresponding substantially to the radius of the guide roll, with the cooperation of the comber cylinder.

The guide roll can abut on the upper feed roll. As long as a sliver is present, the guide roll then naturally abuts on the upper feed roll with this sliver located between them. In order to make this pressure independent of the thickness of the sliver, the guide roll can preferably be guided so as to be movable towards the upper feed roll, in the direction perpendicular to its rotation axis, and is pressed against the upper feed roll by means of loading means.

It is also possible to mount the guide roll with a fixed rotation axis. In this case, however, it is advisable to arrange the guide roll at a small, preferably adjustable spacing from the upper feed roll.

The guide roll can have a smooth, metallic circumferential surface. Its diameter may be relatively small, preferably not more than 20 mm. A diameter of from 8 to 18 mm, preferably from 10 to 17 mm is particularly advantageous.

The rail can be attached to fixed supports and the spacings of the first and second portions from the upper feed roll and the comber cylinder can be adjusted by means of spacers of different thicknesses which can be fitted to the supports.

The first and second levers can be hinged to each of the two longitudinal ends of the rail, the first levers being pivotable about a pivot axis which is coaxial with the rotation axis of the upper feed roll while the second levers are pivotable about a pivot axis coaxial with the rotation axis of the comber cylinder. The spacings between the bearing points of the levers on the rail and the pivot axes of the levers, for independent adjustment of the spacings of the first and second portions from the upper feed roll and comber cylinder, respectively, are adjustable independently of each other, preferably by means of worm gears.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
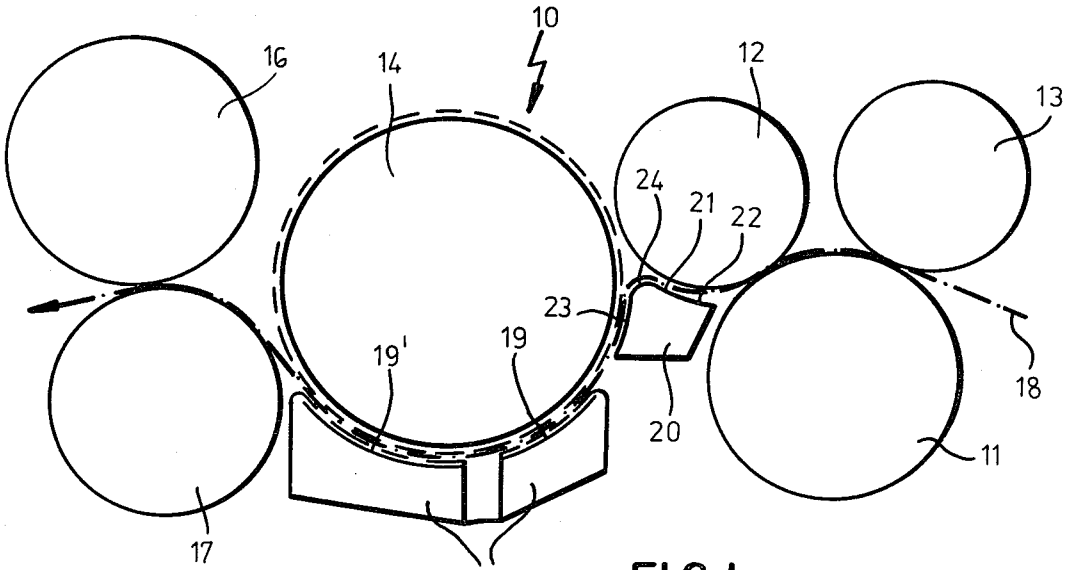
FIG. 1 is a schematic side elevation of a combing and drawing frame according to one embodiment of the invention.

The combing and drawing frame 10 shown in FIG. 1 has a driven metallic, grooved lower feed roll 11 against which an upper entry roll 13 and an upper feed roll 12 are pressed.

The upper roll 12 has an elastic covering of rubber or the like forming its outer circumference and is pressed against the lower feed roll 11 with which it forms the pair of feed rolls 11, 12 of this combing and drawing frame 10.

Moreover, this combing and drawing frame comprises a comber cylinder 14 with a stationary comber bed 15 associated with it and a pair of delivery rolls 16, 17. All the rolls shown are rotatably mounted in fixed pivot bearings. The rolls 11, 14 and 17 are driven directly, while the rolls 11, 17 drive the rolls 12, 13, 16 which are pressed against them with high loading pressures.

The surface speed of the comber cylinder 14 is higher than the surface speed of the two feed rolls 11, 12, so that the collection of fibers or sliver 18 running through this combing and drawing frame 10 is drawn thereon and subsequently combed by means of the comber cylinder 14 and the comber bed 15 cooperating therewith. The pair of delivery rolls 16, 17 delivers the combed and drawn sliver to a removal point or to a machine which will process it further.

The circumference of the comber cylinder 14 is provided with sawtooth clothing in the usual way. The stationary comber bed 15 also has sawtooth clothing (see U.S. Pat. No. 4,083,085) in the two areas 19, 19' located opposite the comber cylinder 14. These two areas 19, 19' are separated from each other by a slot.

In order to improve the uniformity of the sliver treated in this combing and drawing frame, a stationary profiled rail 20 having a deflection guide slideway 21 is mounted between the pair of feed rolls 11, 12 and the comber cylinder 14. The deflection guide slideway 21 extends at least over the working width of this combing and drawing frame and is preferably metallic and may appropriately be polished.

It guides the sliver 18 from the pair of feed rolls 11, 12 to the comber cylinder 14 and deflects it together with the comber cylinder in a narrow arc to abut on the comber cylinder 14.

The deflection guide slideway 21 is continuously curved in the direction of travel of the sliver 18 and consists of a first portion 22 having a concave curvature in the direction of travel of the sliver 18, an adjoining intermediate portion 24 curved in an arc shape in the direction of travel of the sliver 18, and a second portion 23 adjoining the intermediate portion 24 and having a concave curvature in the direction of travel of the sliver 18. The concave curvatures of the first and second portions 22, 23 are adapted to fit the circumferential curvature of the upper feed roll 12 or comber cylinder 14 lying opposite them, so that the concave first and second portions 22, 23 can be adjusted in such a way as to be at a substantially constant spacing, over both their width and length, from the circumference of the upper feed roll 12 or from the teeth of the sawtooth clothing (covering) of the comber cylinder 14. The intermediate portion 24 extends over an angle at the center of rather more than 90°. Its radius of curvature may preferably be 3 to 5 mm, more particularly about 4 mm.

The spacing of the first portion 22 from the upper feed roll 12 located opposite it and the spacing of the second portion 23 from the comber cylinder 14 opposite it are adjustable independently of each other, so that these spacings can be adapted to sliver of different thicknesses and with different fiber compositions. The spacing of the first portion 22 from the upper feed roll 12 should be adjusted so that the sliver 18 is pressed against the elastic circumferential covering of the upper feed roll by the first portion 22.

The spacing of the second portion 23 from the comber cylinder 14 is also small.

As the spacings of these two portions 22, 23 from the upper feed roll 12 or from the comber cylinder 14, as the case may be, are adjustable independently of each other, they can be adapted to suit the sliver as far as possible.

Figure 2:
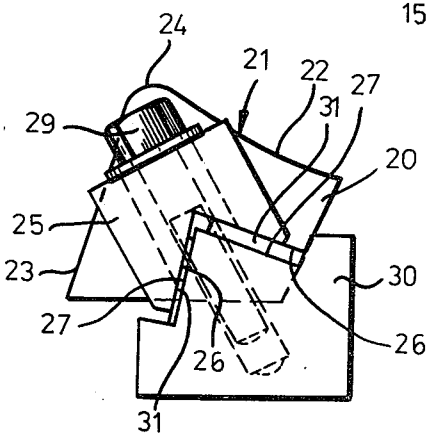
FIG. 2 is a side elevational of a rail comprising a deflection guide slideway and a holder serving to secure the rail in an adjustable position.
Figure 3:
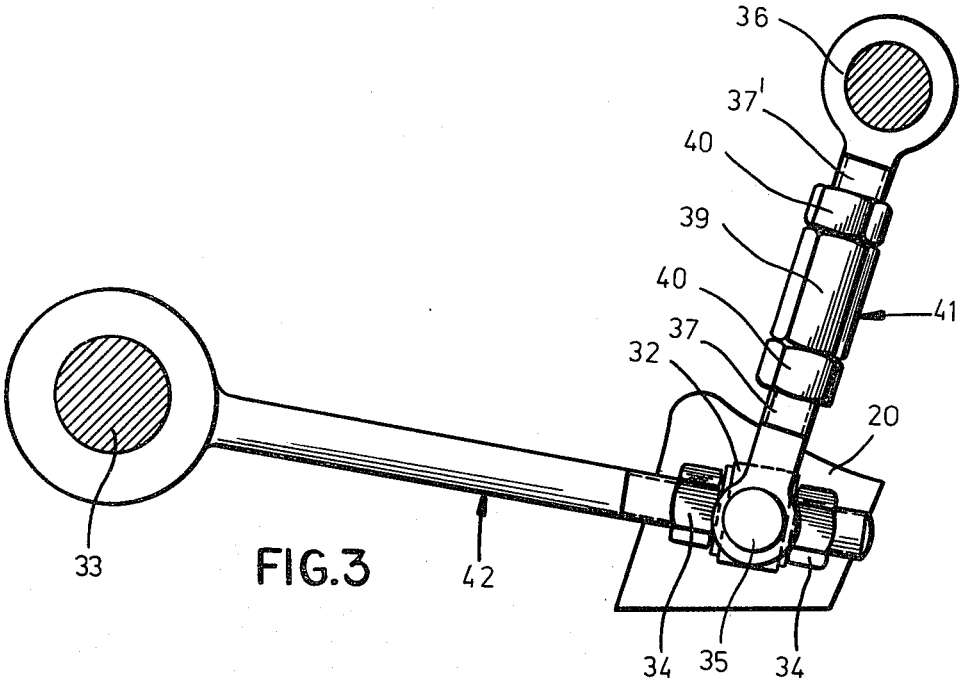
FIG. 3 shows another embodiment of a holder for a rail comprising a deflection guide slideway.

FIGS. 2 and 3 show two different advantageous methods of securing the profiled rail 20 of the combing and drawing frame 10, which permit independent adjustment of the spacings of the first and second portions 22, 23 thereof from the upper feed roll 12 and from the comber cylinder 14. For this purpose, in the embodiment shown in FIG. 2, an angle piece 25 is secured to each end face of the profiled rail 20; this angle piece 25 comprises two flat abutment surfaces 26 arranged at an angle of rather less than 90° to each other, which, with the intercalation of spacers 31 of different thicknesses, can be placed fully on the support surfaces 27, arranged at the same angle to each other, of a support member 30 fixedly mounted on the combing and drawing frame 10. A threaded bore is provided in the support member 30 and a throughbore is provided in the angle piece 25 so that the angle piece 25 can be secured to the support member 30 by means of a screw 29. By exchanging the spacers 31 for spacers of different thickness or by additionally inserting or removing spacers, the spacings of the first portion 22 and second portion 23 from the upper feed roll 12 and comber cylinder 14, respectively, can be adjusted differently, independently of each other. The two abutment surfaces 26 extend parallel to tangents of the first and second portions 22, 23.

In the method of clamping the profiled rail shown in FIG. 3, a bushing 32 with a cylindrical throughging bore is attached to each end face of the profiled rail 20. Each bushing 32 has a rod-shaped lever 42 passing through it, the lever 42 being pivotally mounted on a bearing pin 33 which is coaxial with the rotation axis of the comber cylinder 14. The other end of the lever 42 comprises a thread, having a nut 34 screwed on to it on each side of the bushing 32. By turning these nuts 34, the spacing of the bushing 32 and hence of the profiled rail 20 from the rotation axis of the lever 42 and therefore from the rotation axis of the comber cylinder 14 can be adjusted, in order to alter the spacing of the second portion 23 of the profiled rail 20 from the comber cylinder 14.

Moreover, a bearing pin 35 having its longitudinal axis parallel to the rotation axis of the comber cylinder 14 is secured to each bushing 32 and the bearing eyelet of a rod-like lever 41 of adjustable length is rotatably mounted on this bearing pin 35, while the other end of the lever 41 is rotatably mounted on a bearing pin 36 coaxial with the rotation axis of the upper feed roll 12. This lever 41 has two threaded rods 37, 37' coaxial with each other, while a nut 39 is rotatably mounted on the end of the threaded rod 37'; this nut is not guided on the thread of this threaded rod 37' but can be rotated about its longitudinal axis without altering its axial position relative to the threaded rod 37'.

The other threaded rod 37 is screwed into this nut 39 and the length of this lever 41 can thus be adjusted by rotation of this nut 39. Two locknuts 40 serve to clamp the nut 39 in place, in order to prevent any accidental adjustment of the length of the lever 41 after the adjustment has been made. Thus, the spacing of the first portion 22 from the upper feed roll 12 can be adjusted by turning the nut 39.

Figure 4:
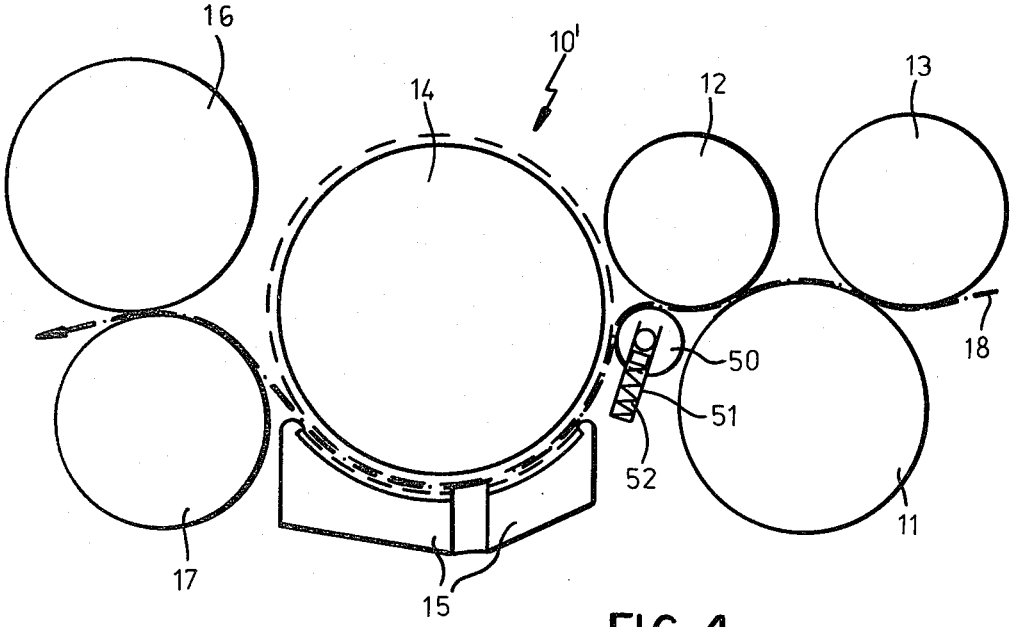
FIG. 4 shows a combing and drawing frame viewed as in FIG. 1, according to a second embodiment of the invention.

The combing and drawing frame 10' shown in FIG. 4 may correspond to that shown in FIG. 1, with the one difference that, instead of the profiled rail 20, a guide roll 50 is provided for guiding and deflecting the sliver 18 in its journey from the nip of the pair of feed rolls 11, 12 to the comber bed 15. This guide roll 50 is capable of rotating freely about its rotation axia parallel to the rotation axis of the upper feed roll 12 and can thus be driven, virtually without slipping, by the upper feed roll via the sliver 18 located between them. Preferably, it may be guided so as to be movable at right angles to its rotation axis, approximately towards the rotation axis of the upper feed roll, for ecample by means of a guide 51 or swing arms or the like carrying it, and may be loaded, preferably by spring means 52, in such a way that it abuts constantly on the upper feed roll 12. As long as a sliver 18 is present, the guide roll 50 then abuts on the upper feed roll 12, with the sliver 18 located in between.

The pressure with which the guide roll 50 is pressed against the upper feed roll 12 can be adjusted to suit the particular requirements. At least in a number of cases, it may be so slight that the comber cylinder 14 is able to pull the fibers which it has gripped out of the region (gap) between the guide roll 50 and the upper feed roll 12. However, at least in a number of cases, it is also possible to make the loading pressure of the guide roll 50 greater so that the fibers in the region (gap) between the guide roll 50 and the upper feed roll 12 can then move substantially only at the surface speed of the upper feed roll 12.

In the case of the combing and drawing frame 10 according to FIG. 1, the spacing of the profiled rail 20 from the upper feed roll 12 is adjusted so that optimum uniformity of the sliver 18 is obtained. Preferably, in this case, the first portion 22 of the deflection guide slideway 21 presses the sliver against the upper feed roll 12 with weak pressure.

I claim:

1. In a combing and drawing frame for a spinning mill, for drawing and combing drawable collections of fibers in the form of sliver consisting of individual fibers, with a pair of feed rolls including an upper feed roll and a lower feed roll which deliver the collection of fibers to a comber cylinder cooperating with a comber bed, the surface speed of the comber cylinder being greater than the surface speed of the feed rolls, and with a pair of delivery rolls mounted behind the comber cylinder, the improvement which comprises, between the pair of feed rolls and the comber cylinder and in front of the comber bed, a deflection guide for the sliver, this guide being at a small spacing from the comber cylinder and pressing the sliver against the upper feed roll, said deflection guide being constructed as a stationary deflection guide slideway for the sliver, this slideway having a first portion opposite the upper feed roll and a second portion opposite the comber cylinder.

2. The improvement defined in claim 1 wherein the deflection guide (21) is also at a small spacing from the upper feed roll (12).

3. The improvement defined in claim 2 further comprising means for adjusting at least one of said spacings.

4. The improvement defined in claim 1 wherein the first and second portions are connected to each other via a rounded intermediate portion.

5. The improvement defined in claim 4 wherein the intermediate portion has an arc-shaped convexity.

6. The improvement defined in claim 5 wherein the radius of curvature of the intermediate portion is approximately 3 to 5 mm.

7. The improvement defined in claim 4, claim 5 or claim 6 wherein in order to fit the circumferential curvature of the opposing upper feed roll and comber cylinder, the first and second portions of the slideway are curved in a concave arrangement.

8. The improvement defined in claim 7 wherein the deflection guide slideway is formed by a surface portion of a profiled rail extending parallel to the longitudinal axis of the comber cylinder and upper feed roll.

9. The improvement defined in claim 1 wherein the upper feed roll has an elastic covering of rubber forming its circumferential surface, and in that the lower feed roll is a grooved metal roll.

10. The improvement defined in claim 1 wherein the deflection guide presses the sliver against the upper feed roll with so little pressure that the comber cylinder is able to pull the fibers which it has gripped out of the region between the deflection guide and the upper feed roll.

11. The improvement defined in claim 1 wherein the deflection guide presses the sliver against the upper feed roll with a pressure such that the fibers in the region between the upper feed roll and the deflection guide are substantially only able to move at the surface speed of the upper feed roll.

12. In a combing and drawing frame for a spinning mill, for drawing and combing drawable collections of fibers in the form of sliver consisting of individual fibers, with a pair of feed rolls including an upper feed roll and a lower feed roll which deliver the collection of fibers to a comber cylinder cooperating with a comber bed, the surface speed of the comber cylinder being greater than the surface speed of the feed rolls, and with a pair of delivery rolls mounted behind the comber cylinder, the improvement which comprises, between the pair of feed rolls and the comber cylinder and in front of the comber bed, a deflection guide for the sliver, this guide being at a small spacing from the comber cylinder and pressing the sliver against the upper feed roll, said deflection guide being constructed as a stationary deflection guide slideway for the sliver, this slideway having a first portion opposite the upper feed roll and a second portion opposite the comber cylinder, said deflection guide being formed by a surface portion of a profile rail extending parallel to the longitudinal axis of the comber cylinder and upon the feed roll, a fixed support carrying said rail and spacer means of different thicknesses receivable on said support for adjusting the spacings of said first and second portions from the upper feed roll and the comber cylinder.

13. In a combing and drawing frame for a spinning mill, for drawing and combing drawable collections of fibers in the form of sliver consisting of individual fibers, with a pair of feed rolls including an upper feed roll and a lower feed roll which deliver the collection of fibers to a comber cylinder cooperating with a comber bed, the surface speed of the comber cylinder being greater than the surface speed of the feed rolls, and with a pair of delivery rolls mounted behind the comber cylinder, the improvement which comprises, between the pair of feed rolls and the comber cylinder and in front of the comber bed, a deflection guide for the sliver, this guide being at a small spacing from the comber cylinder and pressing the sliver against the upper feed roll, said deflection guide being constructed as a stationary deflection guide slideway for the sliver, this slideway having a first portion opposite the upper feed roll and a second portion opposite the comber cylinder, said deflection guide being formed by a surface portion of a profile rail extending parallel to the longitudinal axis of the comber cylinder and upper feed roll, first and second levers being hinged to each of two opposite ends of the rail, the first levers being pivotable about a pivot axis coaxial with the rotation axis of the upper feed roll, said second levers being pivotable about a pivot axis coaxial with the rotation of the comber cylinder, the spacings between the bearing points of the levers on the rail and the pivot axes of the levers being independently adjustable.

* * * * *